US009091188B2

(12) United States Patent
Nagakura et al.

(10) Patent No.: US 9,091,188 B2
(45) Date of Patent: Jul. 28, 2015

(54) CAMSHAFT SUPPORT STRUCTURE FOR INTERNAL COMBUSTION ENGINE

(71) Applicant: HONDA MOTOR CO., LTD., Tokyo (JP)

(72) Inventors: Masaki Nagakura, Wako (JP); Yoshimi Ishii, Wako (JP); Sei Maruyama, Wako (JP); Machiko Harada, Wako (JP); Yoshiki Matsushiro, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 13/676,099

(22) Filed: Nov. 14, 2012

(65) Prior Publication Data

US 2013/0133600 A1 May 30, 2013

(30) Foreign Application Priority Data

Nov. 25, 2011 (JP) ..... 2011-257918

(51) Int. Cl.
*F01L 1/02* (2006.01)
*F01M 9/10* (2006.01)

(52) U.S. Cl.
CPC ..... *F01M 9/10* (2013.01)

(58) Field of Classification Search
CPC ..... F01M 9/10
USPC ..... 123/90.27, 90.31, 90.6
See application file for complete search history.

(56) References Cited

U.S. PATENT DOCUMENTS 4,777,842 A * 10/1988 Yamada ..... 74/567
5,948,973 A 9/1999 Fujii et al.
5,987,973 A 11/1999 Fujii et al.
6,481,270 B1 * 11/2002 Kobayashi et al. ..... 73/114.26
6,868,835 B2 * 3/2005 Tsubouchi ..... 123/508
8,307,799 B2 11/2012 Shin
8,387,576 B2 * 3/2013 Iwata ..... 123/90.17

(Continued)

FOREIGN PATENT DOCUMENTS

CN 1167255 A 12/1997
CN 1287220 3/2001

(Continued)

OTHER PUBLICATIONS

Japanese Office Action for corresponding JP Application No. 2011-257918, Aug. 26, 2014.

(Continued)

*Primary Examiner* — Zelalem Eshete
(74) *Attorney, Agent, or Firm* — Mori & Ward, LLP

(57) ABSTRACT

A camshaft support structure for an internal combustion engine includes a cylinder head, a camshaft, a plurality of bearings, an auxiliary machine drive cam, an auxiliary machine, and a pulsar plate. The plurality of bearings include a terminal bearing supporting the camshaft to be rotatable with respect to the cylinder head about a rotational axis. The auxiliary machine has a plunger provided to be moved forward and backward by the auxiliary machine drive cam. The pulsar plate projects from the camshaft in a radial direction of the camshaft and is provided on an opposite side of the auxiliary machine drive cam with respect to the terminal bearing. The pulsar plate has a second surface facing the terminal bearing in the axial direction. Each of the first surface and the second surface is provided to slidably contact the terminal bearing.

10 Claims, 4 Drawing Sheets

(56) References Cited

U.S. PATENT DOCUMENTS

| | | | | |
|---|---|---|---|---|
| 8,511,269 | B2 | 8/2013 | Reinhart et al. | |
| 2003/0101949 | A1* | 6/2003 | Uchida | 123/90.12 |
| 2004/0089255 | A1* | 5/2004 | Lee | 123/90.6 |
| 2004/0211376 | A1* | 10/2004 | Mae et al. | 123/90.6 |
| 2004/0211377 | A1* | 10/2004 | Nagano et al. | 123/90.6 |
| 2005/0076870 | A1* | 4/2005 | Nakamura et al. | 123/90.27 |
| 2007/0283913 | A1* | 12/2007 | Reinhart et al. | 123/90.34 |
| 2010/0089359 | A1* | 4/2010 | Cunningham | 123/195 C |
| 2011/0100319 | A1* | 5/2011 | Shin | 123/196 R |
| 2013/0133600 | A1* | 5/2013 | Nagakura et al. | 123/90.34 |

FOREIGN PATENT DOCUMENTS

| | | | |
|---|---|---|---|
| CN | 1517516 | | 8/2004 |
| CN | 101086215 | | 12/2007 |
| CN | 101815850 | | 8/2010 |
| CN | 102052121 | | 5/2011 |
| JP | 64-011305 | U | 1/1989 |
| JP | 2789220 | B | 1/1991 |
| JP | 09-280084 | | 10/1997 |
| JP | 2005-155475 | | 6/2005 |

OTHER PUBLICATIONS

Chinese Office Action for corresponding CN Application No. 201210417259.7, Jul. 31, 2014.

Chinese Office Action for corresponding CN Application No. 201210417259.7, Apr. 14, 2015.

* cited by examiner

CAMSHAFT SUPPORT STRUCTURE FOR INTERNAL COMBUSTION ENGINE

CROSS-REFERENCE TO RELATED APPLICATIONS

The present application claims priority under 35 U.S.C. §119 to Japanese Patent Application No. 2011-257918, filed Nov. 25, 2011, entitled "Camshaft Support Structure for Internal Combustion Engine." The contents of this application are incorporated herein by reference in their entirety.

BACKGROUND OF THE INVENTION

1. Field of the Invention

The present disclosure relates to a camshaft support structure for an internal combustion engine.

2. Discussion of the Background

In an internal combustion engine, the camshaft is rotatably supported by a plurality of bearings provided at a cylinder head. There is a support structure for such a camshaft, which includes a plate-like thrust restricting portion projecting outward in the radial direction from the peripheral surface of the camshaft, and a thrust holder protrusively provided on a bearing to rotatably receive part of the thrust restricting portion (see, for example, Japanese Patent No. 2789220). According to the disclosure of the Japanese Patent No. 2789220, the bearings supporting the camshaft each include a bearing lower portion protrusively and integrally provided on the cylinder head, and a cam cap which is fastened to the bearing lower portion to rotatably support the camshaft with the bearing lower portion. The thrust holder is formed integral with the cam cap.

SUMMARY OF THE INVENTION

According to one aspect of the present invention, a camshaft support structure for an internal combustion engine includes a cylinder head, a camshaft, a plurality of bearings, an auxiliary machine drive cam, an auxiliary machine, and a pulsar plate. The cylinder head has a valve gear chamber. The plurality of bearings are provided in the valve gear chamber of the cylinder head and include a terminal bearing supporting the camshaft to be rotatable with respect to the cylinder head about a rotational axis. The terminal bearing is disposed at one end of the camshaft. The camshaft includes a journal portion and a camshaft extending portion. The journal portion is supported on the terminal bearing. The camshaft extending portion projects from the journal portion along the rotational axis. The auxiliary machine drive cam is provided at the camshaft extending portion and includes a first surface facing the terminal bearing in an axial direction along the rotational direction of the camshaft. The auxiliary machine has a plunger provided to be moved forward and backward by the auxiliary machine drive cam. The pulsar plate projects from the camshaft in a radial direction of the camshaft and is provided on an opposite side of the auxiliary machine drive cam with respect to the terminal bearing. The pulsar plate has a second surface facing the terminal bearing in the axial direction. Each of the first surface and the second surface is provided to slidably contact the terminal bearing.

According to another aspect of the present invention, a camshaft support structure for an internal combustion engine includes a cylinder head, a camshaft, a plurality of bearings, a pulsar plate, and a thrust plate. The cylinder head has a valve gear chamber. The plurality of bearings are provided in the valve gear chamber side of the cylinder head and includes a first bearing supporting the camshaft to be rotatable with respect to the cylinder head about a rotational axis. The pulsar plate is provided at the camshaft and projects in a radial direction of the camshaft. The thrust plate is provided at the camshaft and projects in the radial direction of the camshaft. The first bearing is provided between the pulsar plate and the thrust plate in an axial direction along the rotational axis. The thrust plate has a first surface facing the first bearing in the axial direction. The pulsar plate has a second surface facing the first bearing in the axial direction. Each of the first plane portion and the second plane portion is provided to slidably contact the first bearing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
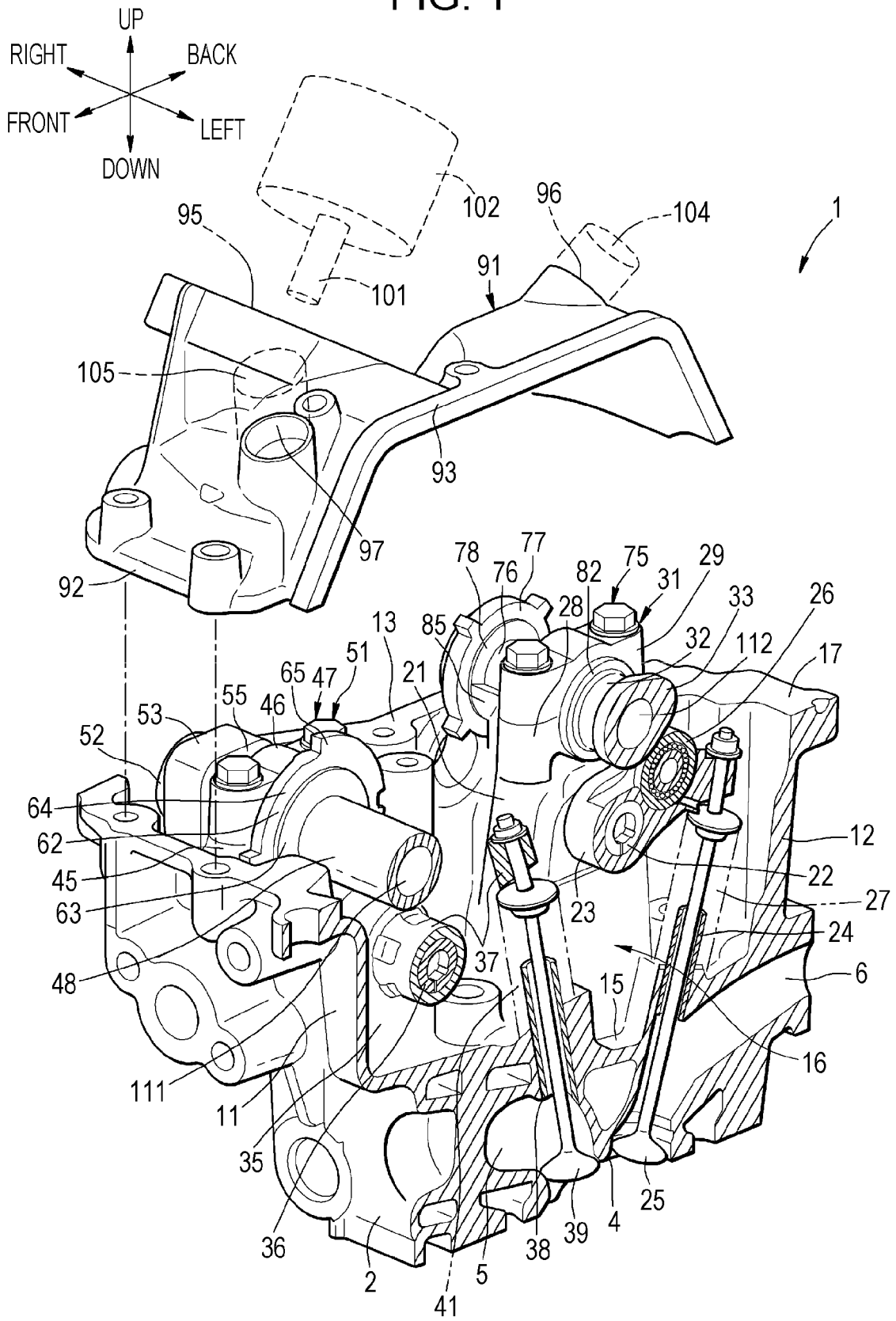
FIG. 1 is an exploded perspective view showing the upper structure of an engine in a cutaway form.

The embodiments will now be described with reference to the accompanying drawings, wherein like reference numerals designate corresponding or identical elements throughout the various drawings.

An engine 1 according to the embodiment is an inline four-cylinder, four-valve DOHC type direct-injection gasoline engine. The directions specified in the diagrams are defined so that "FRONT" is the driving direction of a vehicle body, "UP" is in the direction toward a cylinder head (head cover) for a cylinder block in the cylinder axial direction. The engine 1 is transversely mounted in the vehicle body, and the direction of a cylinder bank (crankshaft direction) matches with the horizontal direction (widthwise direction of the vehicle).

As shown in FIG. 1, a cylinder head 2 has a substantially rectangular parallelepiped lower portion extending horizontally, and a box-shaped upper portion provided on the upper end of the lower portion. Formed in the lower portion of the cylinder head 2 are combustion chambers 4 open to the bottom surface of the cylinder head 2, exhaust ports 5 extending frontward from the combustion chambers 4, and intake ports 6 extending rearward from the combustion chambers 4 and open to the rear side surface of the cylinder head 2. The upper portion of the cylinder head 2, together with a leading edge wall 11, a trailing edge wall 12, a right edge wall 13, and a left edge wall (not shown), and a bottom wall 15, defines a valve gear chamber 16 having a shape of a substantially rectangular parallelepiped box and open upward. The leading edge wall 11, the trailing edge wall 12, the right edge wall 13, and the left edge wall (not shown) are provided upright along the peripheral portion of the lower portion of the cylinder head 2. The bottom wall 15 serves as the top surface of the lower portion of the cylinder head 2. A joined surface 17 facing upward is formed on the upper ends of the leading edge wall 11, the trailing edge wall 12, the right edge wall 13 and the left edge wall.

A plurality of intake-side shaft supports 21 are integrally and protrusively provided at the rear side of the bottom wall 15 in the direction of the cylinder bank (FIG. 1 shows just one intake-side shaft support 21 located on the right end side). Each intake-side shaft support 21 has a wall-like shape having a through hole. An intake-side rocker shaft 22 is securely supported on the intake-side shaft supports 21. The proximal ends of intake-side rocker arms 23 are rotatably supported on the intake-side rocker shaft 22. Through holes are bored through the bottom wall 15 of the cylinder head 2 to the intake ports 6, and intake valve guides 24 are fitted into the respective through holes. Intake valves 25 which are poppet valves have their stems inserted slidably in the respective intake valve guides 24. The intake valve 25 has a stem-side end projecting into the valve gear chamber 16, and a valve body disposed in the combustion chamber 4. Each intake valve 25 is urged by a compression coil 27 in a direction of projecting into the valve gear chamber 16, i.e., a direction in which the valve body closes the intake port 6. The distal end of the intake-side rocker arm 23 presses the stem-side end of the intake valve 25 to push down the intake valve 25, thereby opening and closing the intake port 6. A cam roller 26 is rotatably supported on a lengthwise intermediate portion of each intake-side rocker arm 23.

Figure 3:
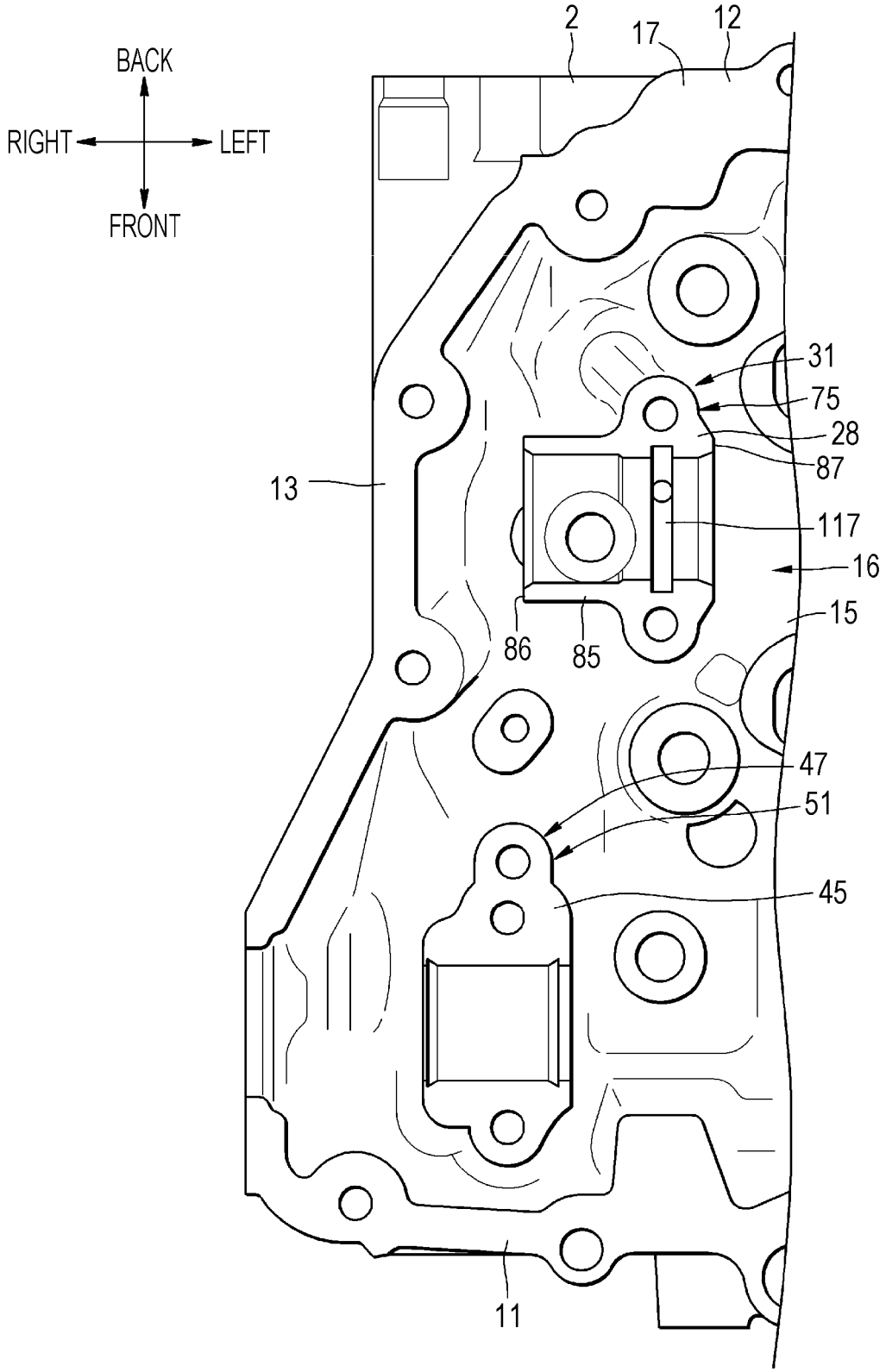
FIG. 3 is a diagram showing the valve gear chamber from above with a camshaft and some other components removed.

As shown in FIG. 3, an intake-side camshaft bearing lower portion 28 having a semicircular recessed groove open upward is formed at the projecting end (upper end) of the intake-side shaft support 21. The intake-side camshaft bearing lower portion 28 may be formed integral with the intake-side shaft support 21, or may be formed separately and fastened to the intake-side shaft support 21. An intake-side cam cap (intake-side camshaft bearing upper portion) 29 is fastened to the top surface of the intake-side camshaft bearing lower portion 28 so as to cover the recess portion. The intake-side camshaft bearing lower portion 28 and the intake-side cam cap 29 form an intake-side camshaft bearing 31.

An intake-side camshaft 32 is rotatably supported on the intake-side camshaft bearings 31. Cams 33 that drive the intake-side rocker arms 23 via the cam rollers 26 are formed at proper locations of the intake-side camshaft 32.

A plurality of exhaust-side shaft supports 35 are integrally and protrusively provided at the front side of the bottom wall 15 in the cylinder bank direction (FIG. 1 shows just one exhaust-side shaft support 35 located on the right end side). Each exhaust-side shaft support 35 has a wall-like shape having a through hole. An exhaust-side rocker shaft 36 is securely supported on the exhaust-side shaft support 35. The proximal ends of exhaust-side rocker arms 37 are rotatably supported on the exhaust-side rocker shaft 36. Through holes are bored through the bottom wall 15 of the cylinder head 2 to the exhaust ports 5, and exhaust valve guides 38 are fitted into the respective through holes. Exhaust valves 39 which are poppet valves have their stems inserted slidably in the respective exhaust valve guides 38. The exhaust valve 39 has a stem-side end projecting into the valve gear chamber 16, and a valve body disposed in the combustion chamber 4. Each exhaust valve 39 is urged by a compression coil 41 in a direction of projecting into the valve gear chamber 16, i.e., a direction in which the valve body closes the exhaust port 5. The distal end of the exhaust-side rocker arm 37 presses the stem-side end of the exhaust valve 39 to push down the exhaust valve 39, thereby opening and closing the exhaust port 5. A cam roller (not shown) is rotatably supported on a lengthwise intermediate portion of each exhaust-side rocker arm 37.

As shown in FIG. 3, an exhaust-side camshaft bearing lower portion 45 having a semicircular recessed groove open upward is formed at the projecting end (upper end) of the exhaust-side shaft support 35. The exhaust-side camshaft bearing lower portion 45 may be formed integral with the exhaust-side shaft support 35, or may be formed separately and fastened to the exhaust-side shaft support 35. An exhaust-side cam cap (exhaust-side camshaft bearing upper portion) 46 is fastened to the top surface of the exhaust-side camshaft bearing lower portion 45 so as to cover the recess portion. The exhaust-side camshaft bearing lower portion 45 and the exhaust-side cam cap 46 form an exhaust-side camshaft bearing 47. An exhaust-side camshaft 48 is rotatably supported on the exhaust-side camshaft bearing 47. Cams (not shown) that drive the exhaust-side rocker arms 37 via the cam rollers are formed at proper locations of the exhaust-side camshaft 48.

Figure 2:
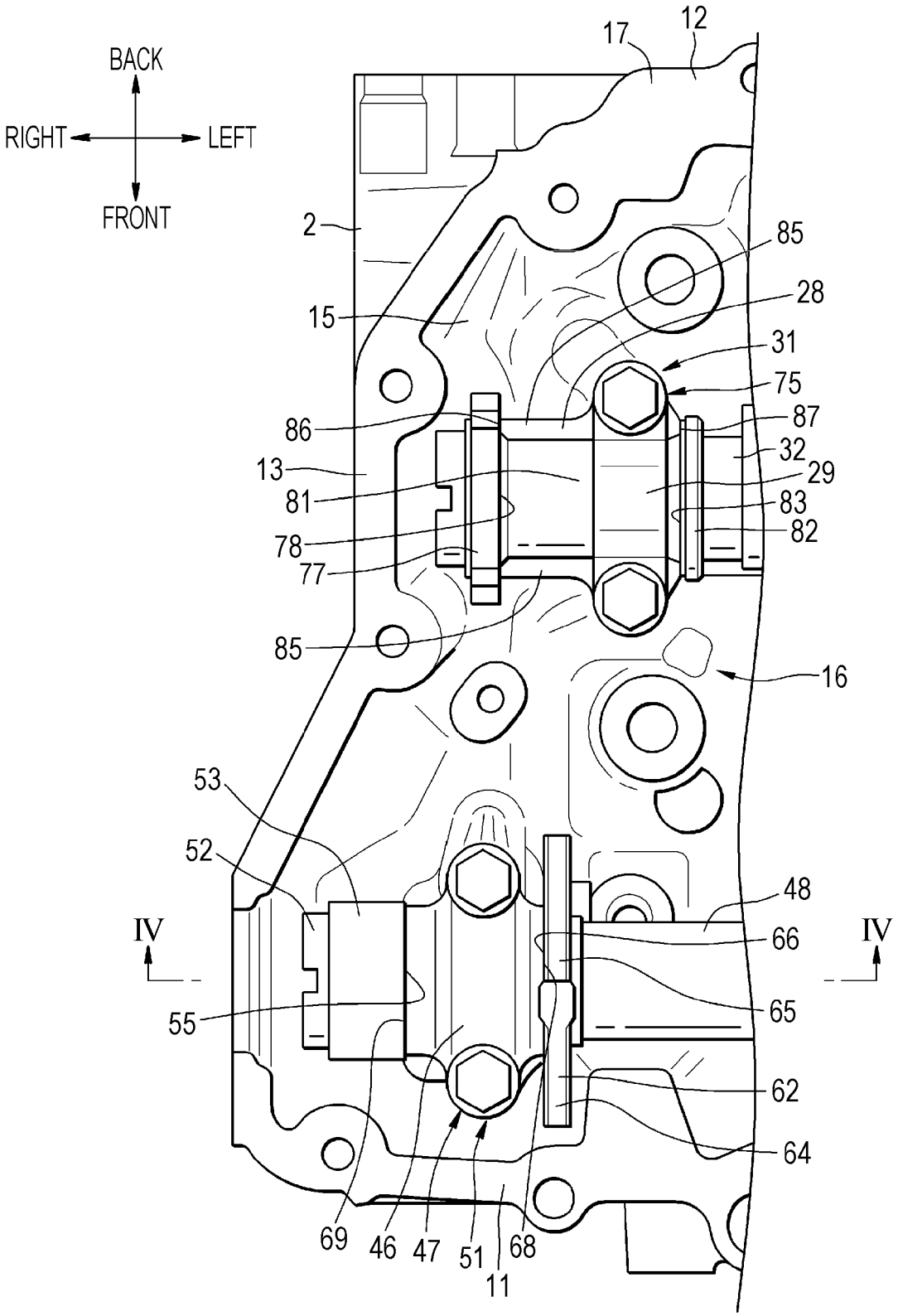
FIG. 2 is a diagram showing a valve gear chamber from above.

The exhaust-side camshaft 48 passes through an exhaust-side terminal bearing 51, one of the plurality of exhaust-side camshaft bearings 47 which is provided on the right end side in the cylinder bank direction (extending direction of the exhaust-side camshaft 48), and further extends rightward to form an exhaust-side camshaft extending portion 52. As shown in FIG. 2, a portion of the right edge wall 13 which faces the exhaust-side camshaft extending portion 52 expands rightward, and the exhaust-side camshaft extending portion 52 is disposed leftward of the right edge wall 13, i.e., disposed in the valve gear chamber 16. The exhaust-side camshaft extending portion 52 is cantilevered on the exhaust-side terminal bearing 51. A pump drive cam 53 projecting outward in the radial direction of the exhaust-side camshaft bearing 47 is formed at the exhaust-side camshaft extending portion 52. The pump drive cam 53 has a circumferentially continuous annular cam surface at its projecting end. The pump drive cam 53 has a pump drive cam end face 55 at a left end portion or a portion facing the exhaust-side terminal bearing 51. The pump drive cam end face 55 is a plane orthogonal to the axis line of the exhaust-side camshaft 48.

Provided that a portion of the exhaust-side camshaft 48 which is supported on the exhaust-side terminal bearing 51 serves as an exhaust-side journal portion 61, a disk-shaped exhaust-side pulsar plate 62 projecting outward in the radial direction is provided at a portion of the exhaust-side camshaft 48 which is located leftward of the exhaust-side journal portion 61 (on a side which is opposite to the pump drive cam 53). The exhaust-side pulsar plate 62 has a disk-shaped proximal portion 63 formed integral with the exhaust-side camshaft 48, and an annular peripheral portion 64 joined to the periphery of the proximal portion 63. A projection 65 for generating a pulse signal according to the rotation is provided on the outer portion of the peripheral portion 64 so as to project outward in the radial direction. The proximal portion 63 has an exhaust-side pulsar plate end face 66 on its right end portion, i.e., at a portion facing the exhaust-side terminal bearing 51. The exhaust-side pulsar plate end face 66 is a plane orthogonal to the axis line of the exhaust-side camshaft 48. The peripheral portion 64 is narrow horizontally (in the axial direction of the exhaust-side camshaft 48) compared to the proximal portion 63, and is disposed biased leftward of the exhaust-side pulsar plate end face 66.

As shown in FIG. 2, the exhaust-side cam cap 46 which constitutes the exhaust-side terminal bearing 51 has, on its left and right side portions, a left end face 68 and a right end face 69 which are planes orthogonal to the axis line of the exhaust-side camshaft 48. The left end face 68 and the right end face 69 of the exhaust-side cam cap 46 are disposed so as to protrude leftward and rightward of the exhaust-side camshaft bearing lower portion 45 constituting the exhaust-side terminal bearing 51. That is, the exhaust-side cam cap 46 constituting the exhaust-side terminal bearing 51 are wider horizontally than the exhaust-side camshaft bearing lower portion 45.

With the exhaust-side camshaft 48 supported on the exhaust-side terminal bearing 51, the pump drive cam end face 55 of the pump drive cam 53 slides in contact with the right end face 69 of the exhaust-side cam cap 46, and the exhaust-side pulsar plate end face 66 of the proximal portion 63 of the exhaust-side pulsar plate 62 slides in contact with the left end face 68 of the exhaust-side cam cap 46. That is, the exhaust-side cam cap 46 is held between the pump drive cam 53 and the exhaust-side pulsar plate 62 in the axial direction of the exhaust-side camshaft 48. This configuration restricts the movement of the exhaust-side camshaft 48 in the thrust direction. Because the exhaust-side cam cap 46 protrudes horizontally more than the exhaust-side camshaft bearing lower portion 45, the pump drive cam 53 and the proximal portion 63 of the exhaust-side pulsar plate 62 do not contact the exhaust-side camshaft bearing lower portion 45. In addition, the peripheral portion 64 of the exhaust-side pulsar plate 62 is disposed biased leftward of the exhaust-side pulsar plate end face 66, and thus does not contact the left end face 68 of the exhaust-side cam cap 46.

The intake-side camshaft 32 passes through an intake-side terminal bearing 75, one of the plurality of intake-side camshaft bearings 31 which is provided on the right end side, and further extends rightward to form an intake-side camshaft extending portion 76. As shown in FIG. 2, the intake-side camshaft extending portion 76 is disposed leftward of the right edge wall 13, i.e., disposed in the valve gear chamber 16. The intake-side camshaft extending portion 76 is cantilevered on the intake-side terminal bearing 75. A disk-shaped intake-side pulsar plate 77 projecting outward in the radial direction of the intake-side camshaft bearing 31 is provided at the intake-side camshaft extending portion 76. A projection for generating a pulse signal according to the rotation is provided on the peripheral portion of the intake-side pulsar plate 77. The intake-side pulsar plate 77 has an intake-side pulsar plate end face 78 at its left end portion, i.e., a portion facing the intake-side terminal bearing 75. The intake-side pulsar plate end face 78 is a plane orthogonal to the axis line of the intake-side camshaft 32.

Provided that a portion of the intake-side camshaft 32 which is supported on the intake-side terminal bearing 75 serves as an intake-side journal portion 81, a disk-shaped thrust plate 82 projecting outward in the radial direction is provided at a portion of the intake-side camshaft 32 which is located leftward of the intake-side journal portion 81 (on a side which is opposite to the intake-side pulsar plate 77). The thrust plate 82 has a thrust plate end face 83 at its right end portion, i.e., a portion facing the intake-side terminal bearing 75. The thrust plate end face 83 is a plane orthogonal to the axis line of the intake-side camshaft 32.

As shown in FIGS. 2 and 3, the intake-side camshaft bearing lower portion 28 constituting the intake-side terminal bearing 75 projects leftward and rightward with respect to the intake-side cam cap 29, and has, at its right side portion, a half-cutaway cylindrical collar 85 (arc of 180°) projecting rightward. The inner surface of the collar 85 is disposed apart from the peripheral surface of the intake-side camshaft (intake-side camshaft extending portion 76). According to another embodiment, the collar 85 may be designed so as to rotatably support the intake-side camshaft 32 at the inner portion from below. The collar 85 has, at its right end, a collar end face 86 which is a plane orthogonal to the axis line of the intake-side camshaft 32. The intake-side camshaft bearing lower portion 28 constituting the intake-side terminal bearing 75 has, at its left end portion, an intake-side bearing lower portion end face 87 which is a plane orthogonal to the axis line of the intake-side camshaft 32.

With the intake-side camshaft 32 supported on the intake-side terminal bearing 75, the intake-side pulsar plate end face 78 of the intake-side pulsar plate 77 slides in contact with the collar end face 86 of the collar 85, and the thrust plate end face 83 of the thrust plate 82 slides in contact with the intake-side bearing lower portion end face 87 of the intake-side camshaft bearing lower portion 28. That is, the intake-side camshaft bearing lower portion 28 and the collar 85 are held between the intake-side pulsar plate 77 and the thrust plate 82 in the axial direction of the intake-side camshaft 32. This configuration restricts the movement of the intake-side camshaft 32 in the thrust direction.

As shown in FIG. 1, a fuel pump support housing 91 is coupled to the upper portion of the cylinder head 2 so as to cover the right end portion of the valve gear chamber 16 from above. The fuel pump support housing 91 has a downward flange 92 with a continuous square-bracket shape, at which the fuel pump support housing 91 is fastened to the joined surface 17 at the right edge wall 13, the leading edge wall 11 and the right end portion of the trailing edge wall 12. With the fuel pump support housing 91 fastened to the cylinder head 2, the fuel pump support housing 91 covers the intake-side camshaft extending portion 76 and the exhaust-side camshaft extending portion 52 from above. With the fuel pump support housing 91 fastened to the cylinder head 2, the left end portion of the fuel pump support housing 91 is open leftward. A left end periphery 93 of the top surface of the fuel pump support housing 91 is overlapped from above by the right end periphery of the head cover (not shown) which covers the upper left portion of the cylinder head 2. The upper portion of the valve gear chamber 16 is blocked by the fuel pump support housing 91 and the head cover this way.

A pump mount hole 95, an intake-side rotational-angle-sensor mount hole 96, and an exhaust-side rotational-angle-sensor mount hole 97 are formed in the fuel pump support housing 91. A publicly known fuel injection pump 102, which is driven by the forward and backward thrust movement of a plunger 101, is mounted in the pump mount hole 95. The plunger 101 passes through the pump mount hole 95 so that its distal end abuts on the pump drive cam 53. The plunger 101 is thrust forward and backward by the pump drive cam 53 to feed fuel into the fuel injection pump 102 and feed out (discharge) fuel under pressure. A rotational angle sensor 104 is mounted in the intake-side rotational-angle-sensor mount hole 96. The rotational angle sensor 104 is a publicly known sensor which uses the Hall effect to detect approaching of a metal. The rotational angle sensor 104 is disposed opposite to the peripheral portion of the intake-side pulsar plate 77 to detect the projection of the intake-side pulsar plate 77. A rotational angle sensor 105 is mounted in the exhaust-side rotational-angle-sensor mount hole 97. The rotational angle sensor 105, similar to the rotational angle sensor 104, is disposed opposite to the peripheral portion of the exhaust-side pulsar plate 62 to detect the projection 65 thereof.

Figure 4:
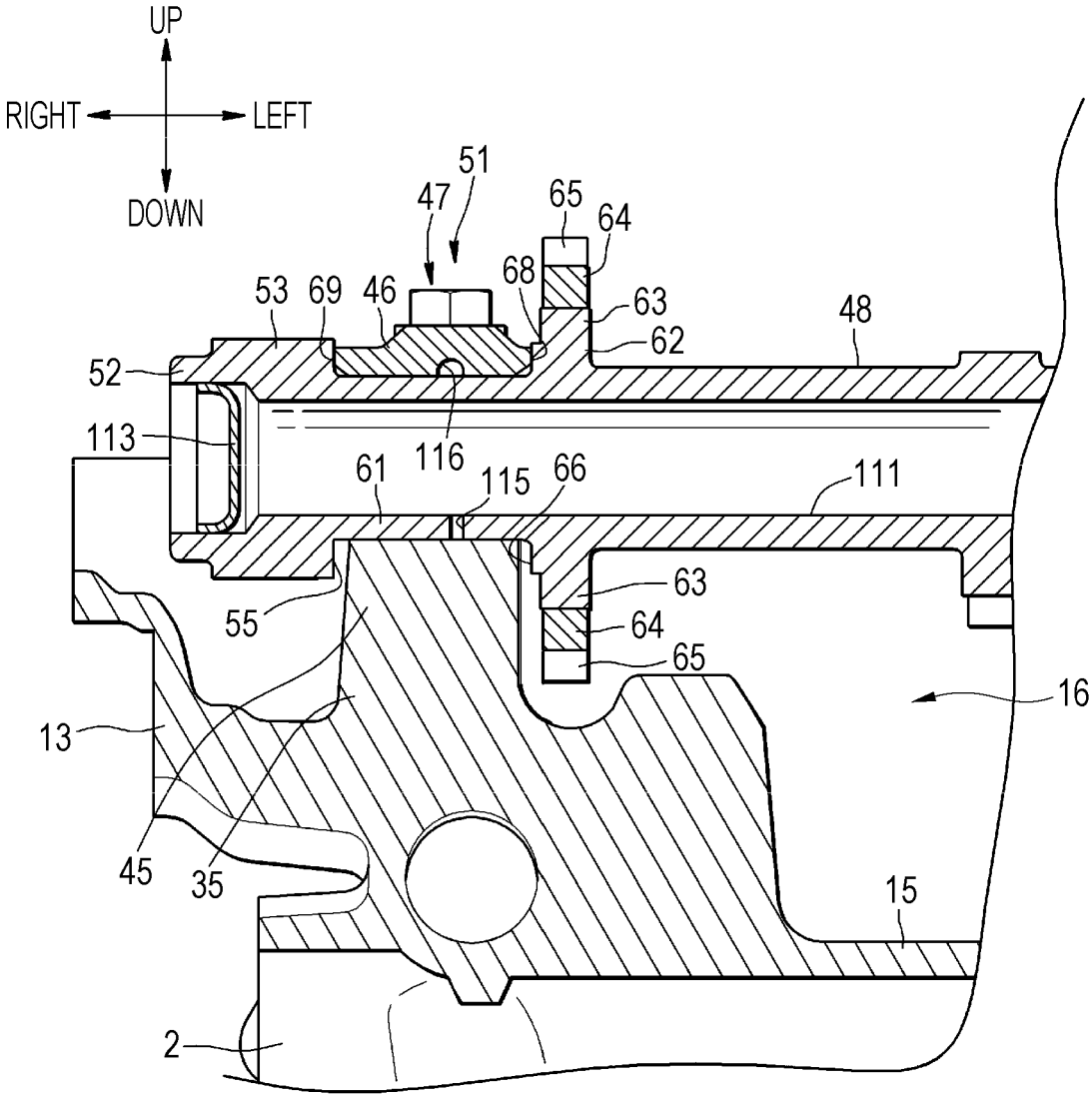
FIG. 4 is a cross-sectional view along line IV-IV in FIG. 2.

Next, a lubrication structure for the exhaust-side terminal bearing 51 and the intake-side terminal bearing 75 will be described. As shown in FIGS. 1 and 4, an exhaust-side camshaft oil passage 111 and an intake-side camshaft oil passage 112 which extend in the axial direction are formed inside the exhaust-side camshaft 48 and the intake-side camshaft 32, respectively. As shown in FIG. 4, the left end of the exhaust-side camshaft oil passage 111 is closed by a cap 113 at an end portion of the exhaust-side camshaft extending portion 52. A communication oil passage 115 radially extending to the exhaust-side camshaft oil passage 111 from the peripheral surface of the exhaust-side journal portion 61 is formed in the exhaust-side journal portion 61. An exhaust-side bearing lubrication groove 116 extending in the circumferential direction of the exhaust-side camshaft 48 is formed in a support surface (slide surface) of the exhaust-side cam cap 46 which corresponds to that portion of the peripheral surface of the exhaust-side journal portion 61 to which the communication oil passage 115 is open.

A communication oil passage (not shown) radially extending to the intake-side camshaft oil passage 112 from the peripheral surface of the intake-side journal portion 81 is formed in the intake-side journal portion 81. An intake-side bearing lubrication groove 117 extending in the circumferential direction of the intake-side camshaft 32 is formed in a support surface (slide surface) of the intake-side camshaft bearing lower portion 28 which corresponds to that portion of the peripheral surface of the intake-side journal portion 81 to which the communication oil passage is open (see FIG. 3).

According to the above-configured lubrication structure for the exhaust-side terminal bearing 51 and the intake-side terminal bearing 75, the lubrication oil is supplied to the exhaust-side camshaft oil passage 111 and the intake-side camshaft oil passage 112 from the known oil pump (not shown) serving as an engine auxiliary machine via, for example, the cylinder block and the cylinder head 2. The lubrication oil supplied to the exhaust-side camshaft oil passage 111 passes through the communication oil passage 115 to be supplied to the exhaust-side bearing lubrication groove 116. As a result, the lubrication oil is supplied to between the slide surface of the exhaust-side camshaft bearing 47 (exhaust-side terminal bearing 51) and the exhaust-side journal portion 61. The lubrication oil supplied between the slide surfaces overflow from between the slide surfaces to be supplied between the pump drive cam end face 55 and the right end face 69 of the exhaust-side cam cap 46, and between the exhaust-side pulsar plate end face 66 and the left end face 68 of the exhaust-side cam cap 46.

The lubrication oil supplied to the intake-side camshaft oil passage 112 passes through to be supplied to the intake-side bearing lubrication groove 117. As a result, the lubrication oil is supplied between the slide surfaces of the intake-side camshaft bearing 31 (intake-side terminal bearing 75) and the intake-side journal portion 81. The lubrication oil supplied between the slide surfaces overflow from between the slide surfaces, and flows along the inner surface of the collar 85 to be supplied between the intake-side pulsar plate end face 78 and the collar end face 86, and between the thrust plate end face 83 and the intake-side bearing lower portion end face 87.

According to the engine with the foregoing configuration, the movement of the exhaust-side camshaft 48 in the thrust direction is restricted by the pump drive cam 53 and the exhaust-side pulsar plate 62 which hold the exhaust-side terminal bearing 51 horizontally. The movement of the intake-side camshaft 32 in the thrust direction is restricted by the thrust plate 82 and the intake-side pulsar plate 77 which hold the intake-side terminal bearing 75 horizontally.

Because the exhaust-side camshaft 48 is designed so that the exhaust-side cam cap 46 formed separately from the exhaust-side camshaft bearing lower portion 45 slides in contact with the pump drive cam 53 and the exhaust-side pulsar plate 62, it is easy to process the exhaust-side camshaft 48 according to the distance between the pump drive cam end face 55 and the exhaust-side pulsar plate end face 66. Further, the exhaust-side pulsar plate 62 is designed so that the exhaust-side pulsar plate 62 slides in contact with the exhaust-side cam cap 46 only at the proximal portion 63, but the peripheral portion 64 does not contact the exhaust-side cam cap 46. This makes it possible to reduce the contact area to lower the friction resistance. In addition, the rigidity of the peripheral portion 64 can be set low.

Because the intake-side camshaft 32 is designed so that the intake-side camshaft bearing lower portion 28 and the collar 85 formed integral with each other slide in contact with the intake-side pulsar plate 77 and the thrust plate 82, the thrust load is not applied to the joined surfaces of the intake-side camshaft bearing lower portion 28 and the intake-side cam cap 29, thus suppressing opening between the intake-side camshaft bearing lower portion 28 and the intake-side cam cap 29. When the intake-side camshaft bearing lower portion 28 and the intake-side shaft support 21 are formed integrally, the rigidity of the intake-side terminal bearing 75 against the thrust load gets higher.

The scope of the disclosure is not limited to the specific embodiment described above, and encompasses various modifications made to the embodiment without departing from the scope of the disclosure. Although the fuel injection pump 102 is exemplified as an example of an engine auxiliary machine to be mounted on the cylinder head 2 according to the embodiment, another engine auxiliary machine such as a water pump or an air compressor may be adopted. Although the exhaust-side terminal bearing 51 is provided at the cylinder head 2 via the exhaust-side shaft support 35 according to the embodiment, when the configuration is modified so that another auxiliary machine housing such as the fuel injection pump 102 is mounted on the cylinder head 2, and the exhaust-side camshaft 48 is thrust into the auxiliary machine housing, the exhaust-side terminal bearing 51 may be provided in the auxiliary machine housing. That is, the exhaust-side terminal bearing 51 may be provided at another component which is mounted on the cylinder head 2. According to the embodiment, only the exhaust-side cam cap 46 in the exhaust-side camshaft 48 slides in contact with the pump drive cam 53 and the exhaust-side pulsar plate 62, but the exhaust-side camshaft bearing lower portion 45 may also slide in contact with the pump drive cam 53 and the exhaust-side pulsar plate 62. This configuration suppresses opening between the exhaust-side cam cap 46 and the exhaust-side camshaft bearing lower portion 45.

According to one aspect of an exemplary embodiment of the disclosure, a camshaft support structure for an internal combustion engine (1) includes a cylinder head (2) having a valve gear chamber on one side, a plurality of bearings (47) provided on the valve gear chamber side of the cylinder head, a camshaft (48) rotatably supported by the plurality of bearings, one of the plurality of bearings disposed at one end of the camshaft serving as a terminal bearing (51), a camshaft extending portion (52) projecting from the camshaft toward the one end rather than toward the terminal bearing, an auxiliary machine drive cam (53) provided at the camshaft extending portion, an auxiliary machine (102) having a plunger (101) which is thrust forward and backward by the auxiliary machine drive cam, and a pulsar plate (62) provided at the camshaft on that side of a journal portion (61) thereof, supported on the terminal bearing, which is opposite to the auxiliary machine drive cam, and projecting in a radial direction of the camshaft. The auxiliary machine drive cam has a first plane portion (55) at a side portion facing the terminal bearing, the first plane portion being orthogonal to an axis line of the camshaft. The pulsar plate has a second plane portion (66) at a side portion facing the terminal bearing, the second plane portion being orthogonal to the axis line of the camshaft. Each of the first plane portion and the second plane portion slides in contact with the terminal bearing.

According to this configuration of the exemplary embodiment, the pulsar plate protrusively provided on the peripheral surface of the camshaft and the auxiliary machine drive cam sandwich the terminal bearing in the thrust direction of the camshaft, thereby restricting the movement of the camshaft in the thrust direction. It is unnecessary to separately provide a holder to rotatably receive the pulsar plate serving as the thrust plate, and the auxiliary machine drive cam, thus making it possible to reduce the quantity of parts. In addition, the bearings supporting the camshaft have comparatively high rigidity among the components that constitute the cylinder head, and can thus endure the thrust load of the camshaft.

In the camshaft support structure according to the aspect of the exemplary embodiment of the disclosure, preferably, the terminal bearing has a terminal bearing lower portion (45) provided at the cylinder head, and a terminal bearing upper portion (46) fastened to the terminal bearing lower portion, and each of the first plane portion and the second plane portion slides in contact with at least the terminal bearing upper portion.

According to this configuration of the exemplary embodiment, because the terminal bearing upper portion is formed separately from the cylinder head, it is easy to effect processing according to the distance between the first plane portion and the second plane portion.

In the camshaft support structure according to the aspect of the exemplary embodiment of the disclosure, preferably, the terminal bearing has a terminal bearing lower portion (45) provided at the cylinder head, and a terminal bearing upper portion (46) fastened to the terminal bearing lower portion, and each of the first plane portion and the second plane portion slides in contact with at least the terminal bearing lower portion.

According to this configuration of the exemplary embodiment, the thrust load of the camshaft is applied to the terminal bearing lower portion via the pulsar plate or the auxiliary machine drive cam, making it possible to suppress the opening of the fastened surface between the terminal bearing lower portion and the terminal bearing upper portion, and deformation of the terminal bearing upper portion.

In the camshaft support structure according to the aspect of the exemplary embodiment of the disclosure, preferably, a camshaft oil passage (111) extending in an axial direction is formed in the camshaft and the camshaft extending portion, a communication oil passage (115) communicating a peripheral surface of the journal portion and the camshaft oil passage with each other is formed in the journal portion, and a lubrication groove (116) continual to the communication oil passage is provided in a slide surface of the terminal bearing with respect to the journal portion, whereby a lubrication oil is supplied between a slide surface of the journal portion and the slide surface of the terminal bearing from the camshaft oil passage via the communication oil passage and the lubrication groove, and overflows from between the slide surfaces of the journal portion and the terminal bearing to be supplied between slide surfaces of the first plane portion and the second plane portion, and the terminal bearing.

According to this configuration of the exemplary embodiment, the lubrication oil is supplied between the slide surfaces of the terminal bearing and the journal portion, and between the slide surfaces of the first plane portion and the second plane portion, and the terminal bearing.

In the camshaft support structure according to the aspect of the exemplary embodiment of the disclosure, preferably, the pulsar plate includes a disk portion (63) having the second plane portion, and a peripheral portion (64) provided on a peripheral surface of the disk portion and disposed apart from the terminal bearing.

This configuration of the exemplary embodiment makes it possible to reduce the contact area between the pulsar plate and the terminal bearing, thereby lowering the friction resistance. Further, the contact (slide contact) portion of the pulsar plate and the terminal bearing is formed into the disk portion inward in the radial direction at which the disk portion has a higher rigidity than the peripheral portion.

The camshaft support structure according to the aspect of the exemplary embodiment of the disclosure may further include an auxiliary machine support housing (91) coupled to the cylinder head in such a way as to cover the camshaft extending portion, the auxiliary machine drive cam and the pulsar plate, and a rotation sensor (104, 105) that detects a rotation of the auxiliary machine, and the auxiliary machine and the rotation sensor are coupled to the auxiliary machine support housing.

According to this configuration of the exemplary embodiment, the auxiliary machine support housing which supports the auxiliary machine supports the rotation sensor, and covers part of the cylinder head, so that the individual components can be integrated in a compact size.

According to another aspect of the exemplary embodiment of the disclosure, a camshaft support structure for an internal combustion engine (1) includes a cylinder head (2) having a valve gear chamber (16) on one side, a plurality of bearings provided on the valve gear chamber side of the cylinder head, a camshaft (32) rotatably supported by the plurality of bearings, a pulsar plate (77) provided at the camshaft and projecting in a radial direction of the camshaft, and a thrust plate (78) provided at the camshaft and projecting in the radial direction of the camshaft. The pulsar plate and the thrust plate are disposed so as to sandwich a first bearing (31) which is one of the plurality of bearings. The thrust plate has a first plane portion (83) at a side portion facing the first bearing, and the first plane portion is orthogonal to an axis line of the camshaft. The pulsar plate has a second plane portion (78) at a side portion facing the first bearing, the second plane portion being orthogonal to the axis line of the camshaft. Each of the first plane portion and the second plane portion slides in contact with the first bearing.

According to this configuration of the exemplary embodiment, the pulsar plate protrusively provided on the peripheral surface of the camshaft and the thrust plate sandwich the first bearing in the thrust direction of the camshaft, thereby restricting the movement of the camshaft in the thrust direction. It is unnecessary to separately provide a holder to rotatably receive the thrust plate and the pulsar plate, thus making it possible to reduce the quantity of parts.

Configured in the above manner, the camshaft support structure for an internal combustion engine can restrict the movement of the camshaft in the thrust direction with a simple structure.

Obviously, numerous modifications and variations of the present invention are possible in light of the above teachings. It is therefore to be understood that within the scope of the appended claims, the invention may be practiced otherwise than as specifically described herein.

What is claimed is:

1. A camshaft support structure for an internal combustion engine, comprising:

a cylinder head having a valve gear chamber;

a camshaft;

a plurality of bearings provided in the valve gear chamber of the cylinder head and including a terminal bearing supporting the camshaft to be rotatable with respect to the cylinder head about a rotational axis, the terminal bearing being disposed at one end of the camshaft, the camshaft including a journal portion and a camshaft extending portion, the journal portion being supported on the terminal bearing, the camshaft extending portion projecting longitudinally outward from the journal portion along the rotational axis;

an auxiliary machine drive cam provided on the camshaft extending portion that projects longitudinally outward from the journal portion along the rotational axis, the auxiliary machine drive cam including a first surface facing the terminal bearing in an axial direction along the rotational axis of the camshaft;

an auxiliary machine having a plunger provided to be moved forward and backward by the auxiliary machine drive cam;

a pulsar plate projecting from the camshaft in a radial direction of the camshaft and provided on an opposite side of the auxiliary machine drive cam with respect to the terminal bearing, the pulsar plate having a second surface facing the terminal bearing in the axial direction, each of the first surface and the second surface are provided in slidable contact with the terminal bearing;

an auxiliary machine support housing coupled to the cylinder head to cover the camshaft extending portion, the auxiliary machine drive cam and the pulsar plate from above; and a rotation sensor configured to detect a rotation of the pulsar plate, wherein the auxiliary machine drive cam and the pulsar plate sandwich the terminal bearing to restrict movement of the camshaft in the axial direction along the rotational axis of the camshaft, wherein the auxiliary machine and the rotation sensor are coupled to the auxiliary machine support housing, and wherein a portion of an edge wall of the valve gear chamber expands outward such that the camshaft extending portion and the auxiliary machine drive cam are disposed inside the valve gear chamber adjacent to the portion of the edge wall that expands outward.

2. The camshaft support structure according to claim 1, wherein the terminal bearing has a terminal bearing lower portion provided at the cylinder head, and a terminal bearing upper portion fastened to the terminal bearing lower portion, and wherein each of the first surface and the second surface is provided to slidably contact at least the terminal bearing upper portion.

3. The camshaft support structure according to claim 1, wherein the terminal bearing has a terminal bearing lower portion provided at the cylinder head, and a terminal bearing upper portion fastened to the terminal bearing lower portion, and wherein each of the first surface and the second surface is provided to slidably contact at least the terminal bearing lower portion.

4. The camshaft support structure according to claim 1, wherein the camshaft includes a camshaft oil passage extending in the axial direction along the rotational axis of the camshaft and provided in the journal portion and the camshaft extending portion, and a communication oil passage connecting a peripheral surface of the journal portion to the camshaft oil passage and provided in the journal portion, wherein the journal portion includes a journal slide surface, and wherein the terminal bearing includes a bearing slide surface slidable with the journal slide surface of the journal portion, and a lubrication groove provided to communicate with the communication oil passage and provided in the bearing slide surface of the terminal bearing, a lubrication oil overflowing from between the journal slide surface of the journal portion and the bearing slide surface of the terminal bearing to be supplied between the terminal bearing and each of the first surface and the second surface when the lubrication oil is supplied between the journal slide surface and the bearing slide surface from the camshaft oil passage via the communication oil passage and the lubrication groove.

5. The camshaft support structure according to claim 1, wherein the pulsar plate includes a disk portion having the second surface, and a peripheral portion provided on a peripheral surface of the disk portion and spaced apart from the terminal bearing in the axial direction.

6. The camshaft support structure according to claim 2, wherein the terminal bearing lower portion is spaced apart from the first and second surfaces in the axial direction.

7. The camshaft support structure according to claim 1, wherein the first surface is orthogonal to the rotational axis of the camshaft, and wherein the second surface is orthogonal to the rotational axis of the camshaft.

8. The camshaft support structure according to claim 1, further comprising:

an intake-side camshaft;

a plurality of intake-side bearings provided in the valve gear chamber side of the cylinder head and including a first bearing supporting the intake-side camshaft to be rotatable with respect to the cylinder head about an intake-side rotational axis of the intake-side camshaft;

an intake-side pulsar plate provided at the intake-side camshaft and projecting in a radial direction of the intake-side camshaft; and a thrust plate provided for the intake-side camshaft and projecting in the radial direction of the intake-side camshaft, the first bearing being provided between the intake-side pulsar plate and the thrust plate in an axial direction along the intake-side rotational axis, the thrust plate having a first surface facing the first bearing in the axial direction, the intake-side pulsar plate having a second surface facing the first bearing in the axial direction, each of the first surface of the thrust plate and the second surface of the intake-side pulsar plate are provided in slidable contact with the first bearing, wherein the thrust plate and the intake-side pulsar plate sandwich the first bearing to restrict movement of the intake-side camshaft in the axial direction along the rotational axis of the intake-side camshaft.

9. The camshaft support structure according to claim 8, wherein the first surface of the thrust plate is orthogonal to the rotational axis of the intake-side camshaft, and wherein the second surface of the intake-side pulsar plate is orthogonal to the rotational axis of the intake-side camshaft.

10. A camshaft support structure for an internal combustion engine, comprising:

a cylinder head having a valve gear chamber;

an exhaust-side camshaft;

a plurality of exhaust side bearings provided in the valve gear chamber of the cylinder head and including a terminal bearing supporting the exhaust-side camshaft to be rotatable with respect to the cylinder head about an exhaust-side rotational axis, the terminal bearing being disposed at one end of the exhaust-side camshaft, the exhaust-side camshaft including a journal portion and a camshaft extending portion, the journal portion being supported on the terminal bearing, the camshaft extending portion projecting longitudinally outward from the journal portion along the exhaust-side rotational axis;

an auxiliary machine drive cam provided on the camshaft extending portion that projects longitudinally outward from the journal portion along the exhaust-side rotational axis, the auxiliary machine drive cam including a first surface facing the terminal bearing in an axial direction along the exhaust-side rotational axis of the exhaust-side camshaft;

an exhaust-side pulsar plate projecting from the exhaust-side camshaft in a radial direction of the exhaust-side camshaft and provided on an opposite side of the auxiliary machine drive cam with respect to the terminal bearing, the exhaust-side pulsar plate having a second surface facing the terminal bearing in the axial direction, each of the first surface and the second surface are provided in slidable contact with the terminal bearing;

an intake-side camshaft;

a plurality of intake-side bearings provided in the valve gear chamber side of the cylinder head and including a first bearing supporting the intake-side camshaft to be rotatable with respect to the cylinder head about an intake-side rotational axis of the intake-side camshaft;

an intake-side pulsar plate provided at the intake-side camshaft and projecting in a radial direction of the intake-side camshaft;

a thrust plate provided for the intake-side camshaft and projecting in the radial direction of the intake-side camshaft, the first bearing being provided between the intake-side pulsar plate and the thrust plate in an axial direction along the intake-side rotational axis, the thrust plate having a third surface facing the first bearing in the axial direction, the intake-side pulsar plate having a fourth surface facing the first bearing in the axial direction, each of the third surface and the fourth surface are provided in slidable contact with the first bearing;

an auxiliary machine having a plunger provided to be moved forward and backward by the auxiliary machine drive cam;

an auxiliary machine support housing coupled to the cylinder head to cover the camshaft extending portion, the auxiliary machine drive cam, the exhaust-side pulsar plate, and the intake-side pulsar plate from above; and a rotation sensor configured to detect a rotation of one of the exhaust-side pulsar plate and the intake-side pulsar plate, wherein the auxiliary machine drive cam and the exhaust-side pulsar plate sandwich the terminal bearing to restrict movement of the exhaust-side camshaft in the axial direction along the rotational axis of the exhaust-side camshaft, wherein the thrust plate and the intake-side pulsar plate sandwich the first bearing to restrict movement of the intake-side camshaft in the axial direction along the rotational axis of the intake-side camshaft, wherein the auxiliary machine and the rotation sensor are coupled to the auxiliary machine support housing, and wherein a portion of an edge wall of the valve gear chamber expands outward such that the camshaft extending portion and the auxiliary machine drive cam are disposed inside the valve gear chamber adjacent to the portion of the edge wall that expands outward.

* * * * *